US006428032B1

(12) United States Patent
Humbel

(10) Patent No.: US 6,428,032 B1
(45) Date of Patent: Aug. 6, 2002

(54) SAFETY BINDING FOR A SNOWBOARD

(76) Inventor: Roger Marcel Humbel, Hoehenweg 29, CH-8965, Berikon (CH)

( * ) Notice: Subject to any disclaimer, the term of this patent is extended or adjusted under 35 U.S.C. 154(b) by 0 days.

(21) Appl. No.: 09/485,080

(22) PCT Filed: Aug. 3, 1998

(86) PCT No.: PCT/CH98/00329

§ 371 (c)(1),
(2), (4) Date: Jun. 8, 2000

(87) PCT Pub. No.: WO99/06127

PCT Pub. Date: Feb. 11, 1999

(30) Foreign Application Priority Data

Aug. 2, 1997 (CH) ..... 1834/97

(51) Int. Cl.[7] ..... A63C 9/086; A63C 7/00
(52) U.S. Cl. ..... 280/613; 280/618; 280/14.22
(58) Field of Search ..... 280/14.21, 14.22, 280/14.24, 613, 617, 618, 623, 633, 634

(56) References Cited

U.S. PATENT DOCUMENTS 3,869,136 A * 3/1975 Jackson ..... 280/613
3,918,732 A * 11/1975 Wulf ..... 280/618
4,141,570 A * 2/1979 Sudmeier ..... 280/633
4,498,685 A * 2/1985 Zoor ..... 280/618
4,856,808 A * 8/1989 Longoni ..... 280/617
5,044,654 A * 9/1991 Meyer ..... 280/618
5,318,321 A * 6/1994 Dogat et al. ..... 280/633
5,362,087 A * 11/1994 Agid ..... 280/14.22
5,820,155 A * 10/1998 Brisco ..... 280/618
5,915,718 A * 6/1999 Dodge ..... 280/14.21
5,971,419 A * 10/1999 Knapschafer ..... 280/633
6,024,375 A * 2/2000 Johnson ..... 280/633

FOREIGN PATENT DOCUMENTS

SU 1653796 * 6/1991 ..... 280/633

* cited by examiner

*Primary Examiner*—Frank Vanaman
(74) *Attorney, Agent, or Firm*—Ann W. Speckman; James E. Klaniecki; Janet Sleath

(57) ABSTRACT

A safety binding for a snowboard comprising a first part secured to the snowboard and a second part connected to the ski boot or snowboard boot. Both parts are joined to each other by a locking mechanism which can be released using force. The locking mechanism consists of at least two pressure springs which are arranged substantially parallel to each other and substantially parallel to the snowboard. Each spring has a bolt which engages with a locking member.

13 Claims, 4 Drawing Sheets

SAFETY BINDING FOR A SNOWBOARD

CROSS-REFERENCE TO RELATED APPLICATIONS

The present application claims priority to International Patent Application PCT/CH98/00329, filed Aug. 3, 1998 and to Patent Application CH 1834/97, filed Aug. 2, 1997.

BACKGROUND OF THE INVENTION

1. Field of the Invention

The present invention concerns a safety binding for a snowboard.

2. Description of the Related Art.

Safety bindings of various design lay-outs are known as such for application on skis. For snowboards, however, generally still a normal type binding is provided for the boots (hard shell boots or soft boots) which hardly correspond to the criteria required for safety bindings. Some few types of safety bindings are available on the market presently which can fulfil the requirements for snowboards to a certain extent. Among others a safety binding type is known under the trademark "Meyer" which consists of a disk shaped as a spherical segment mounted onto the snowboard and provided with recesses engaging a support plate which enrages under rotation of the snowboard boot thereon. The latter is fastened to the support plate using conventional buckle straps. The support plate presents a central circular opening to be centered onto the circular disk. The support plate furthermore is provided with two rounded bolts arranged on diametrically opposed sides seen in the longitudinal direction which by means of compression springs are pre-tensioned towards the inside and thus can snap into the engaging recesses of the disk. The force excited by the individual compression springs can be pre-set by means of a setting screw. For this purpose a setting scale is provided on the support plate. As a rule the two support plates first are fastened to the spherically shaped disks by rotating them and subsequently the snowboard boots are fastened thereon using the buckle straps. If the snowboarder exerts excessive load onto the snowboard, which can be caused by a rotation of the foot about the longitudinal direction of the foot, about the longitudinal direction of the shinbone or by a combination of these rotations. the support plate then is released from the disk and foot or leg injuries thus can be prevented.

This known type of safety binding actually permits setting merely of the triggering torque moment about the longitudinal direction of the shinbone in such a manner that the other directions of rotation of the foot effect a triggering action of the safety binding always in a pre-determined ratio compared to said torque setting. This signifies that these various triggering torque moments themselves can not be pre-set individually. This can result in false release triggering actions of the safety binding which may induce experienced snowboarders to dispense with safety bindings altogether and to just rely on the usual buckle straps. The number of sports injuries caused by extreme descent style on bumpy track runs or impassable slopes thus could increase noticeably which—quite apart from the painful personal sufferings—is very undesirable economically.

SUMMARY OF THE INVENTION

It thus is the objective of the present invention to create a safety binding for a snowboard which precludes false release triggering altogether and thus meets with greater acceptance with snowboarders.

This objective is met using a safety binding presenting the characteristics described herein.

The safety binding according to the present invention has a locking mechanism between the first element secured to the snowboard and the second element fastened to the ski boot or snowboard boot. It comprises two compression springs extending substantially parallel to the plane of the snowboard. The ends of the compression springs are provided with a bolt meshing with an engaging element. in this arrangement the triggering torque moment in case of a rotation about the longitudinal direction of the shin-bone is governed by the two compression springs which has a decisive effect onto the triggering levels for the two other directions. Thus the occurrence of a false triggering action caused by a rotation of the foot which consists of a combination of the various rotations is excluded to a very large extent.

In an advantageous further development of the inventive safety binding, the clamping forces of the compression springs can be pre-set. In this manner individual settings can be established. Setting using a counter-plate with a spacer element which can be set by rotation, such as a screw, has proven particularly advantageous. The engaging elements advantageously have the form of a trough in such a manner that slight shifting or rotation of the first element relative to the second element can be taken up without a release action being triggered. It proves particularly advantageous to form the engaging elements as arched grooves with a recessed trough for each of the bolts. In this arrangement the bolts are more effectively guided during the snap-on engaging action. In practical use it has proven most useful that the shape of the grooves and/or the troughs can be adjusted with the help of height adjustable inserts, in particular of screws. The embodiment in which the compression springs are provided on the first part laid out as fastening plate and the engaging elements are provided on the second part formed as a boot plate presents the important advantage that great stability of the safety binding is achieved. Furthermore, the compression springs are excellently protected against snow, dirt and ice. Especially for more demanding snowboard runs it has proven useful to provide adjustability of the fastening plate over an angle of about 3° to 10° with respect to its longitudinal direction, in particular about 5° and/or relative to an axis extending at right angles to the longitudinal direction over an angle of about 3° to 10°, in particular about 5° with respect to the plane of the snowboard. These settings, called "canting", and "heel" respectively, are pre-set particularly for the safety binding for the front foot and can be dispensed with for the binding of the back foot. These angles advantageously can be adjusted using two setting screws and two rubber elastic intermediate rings. Furthermore, it has proven particularly advantageous if a stopper is provided on the fastening plate which after a triggering action automatically moves to its stop position.

BRIEF DESCRIPTION OF THE DRAWINGS

Further advantages of the present invention are seen from the dependent patent claims and from the following description in which the present invention is explained in more detail with reference to a design example illustrated in the schematic drawings. It is shown in:

In the figures identical elements are designated using the same reference signs, and the explanations given with reference to a first figure also concern all further figures unless stated otherwise explicitly.

DETAILED DESCRIPTION OF THE INVENTION

Figure 1:
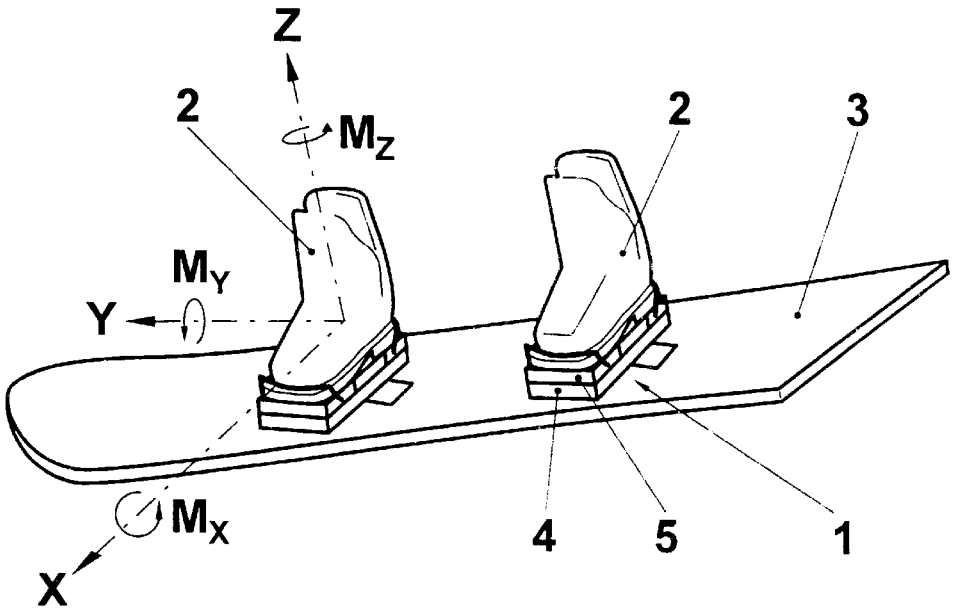
FIG. 1 an axonometric view of a safety binding consisting of two parts with a snowboard boot fastened thereon,
FIG. 2 the first part secured to the snowboard seen in an axonometric view,
FIG. 3 the second part on which the snowboard boot can be fastened seen in an axonometric view,
FIG. 4 a schematic top view in the direction of the arrow A according to the FIG. 2,
FIG. 5 a schematic lateral view of the frame element of the fastening plate seen in the direction of the arrow B according to the FIG. 2, and
FIG. 6 a schematic lateral view of the clamping jaw of the boot plate seen in the direction of the arrow C according to the FIG. 3.

In FIG. 1 an overall view is shown of a safety binding 1 with a snowboard boot 2 comprising substantially of a first part 4 secured to the schematically indicated snowboard 3 and of a second part 5 fastened to the snowboard boot 2. The foot of the snowboarder—not shown here further—now can perform a rotation about the longitudinal direction of the foot (x axis), a rotation about the foot joint (y axis) or a rotation about the longitudinal direction of the shin-bone (z axis). Due to these rotations a torque moment $M_x$ in the x direction, a torque moment $M_y$ in the y direction or a torque moment $M_z$ in the z direction is generated. Any rotation of the foot thus can be split into its components with the help of these three moment directions about axis extending at right angles with respect to each other. Under the biomechanical aspect thus all foot rotations can be determined unanmbiguously.

Figure 2:
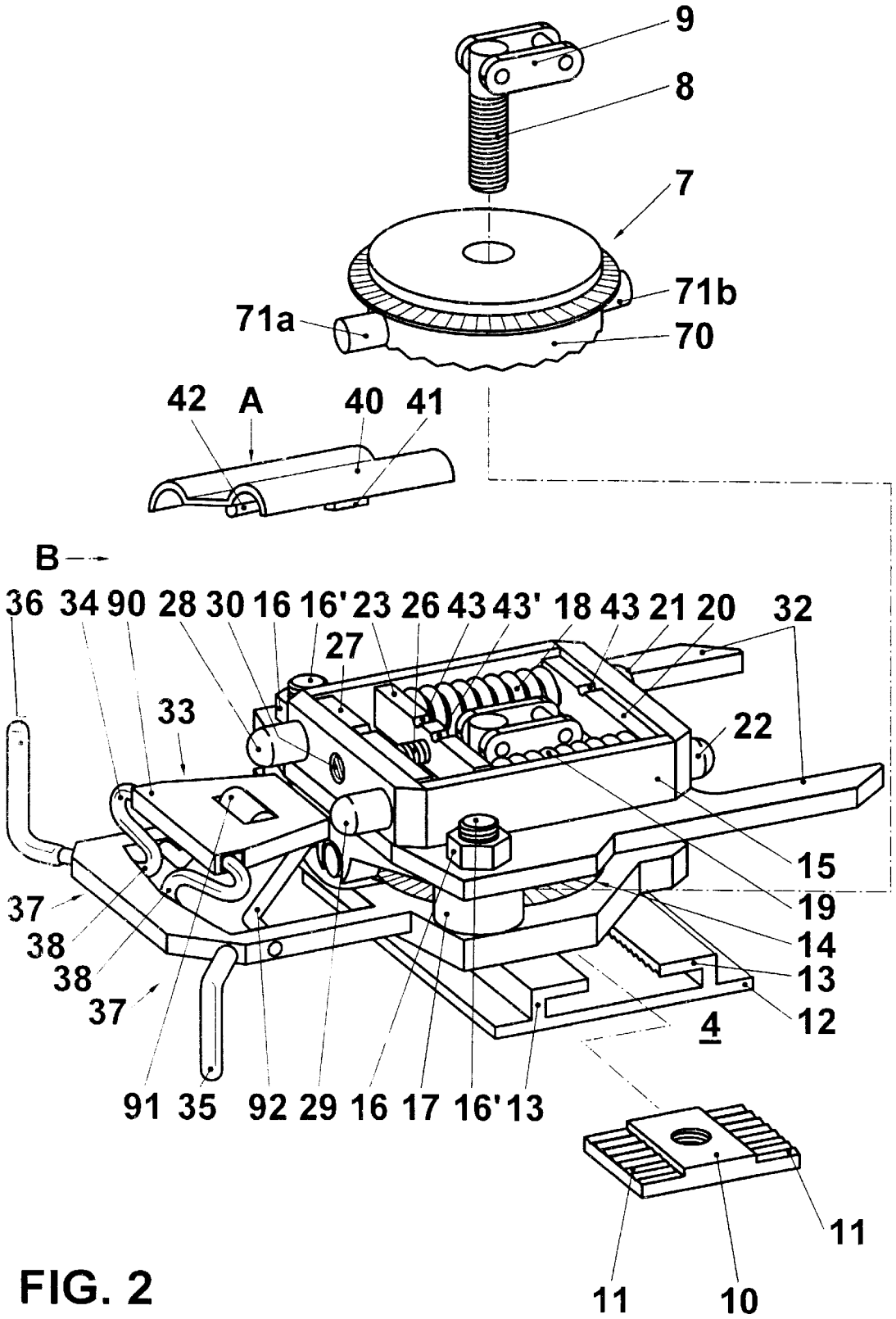

From FIG. 2 the first part 4 designated fastening plate is visible more distinctly, which using an adjusting disk 7 provided with notches can be aligned and set under the correct angle with respect to the snow board 3. The adjusting disk 7 is arranged movable. and can be fixed in a predetermined position, in a U-shaped rail 12 which on its inside also can be knurled, with L-shaped profiles 13 protruding inward, with the help of a through screw 8 with a twist and tilt lever 9 which can be tilted over 90° and a threaded nut 10 with knurled small lateral plates. If the rail 12 is made from a light alloy metal such as an aluminum alloy, surface knurling of the L-shaped profiles 13 can be dispensed with. The adjusting disk 7 on its outer rim is provided with two diametrically opposed protrusions 71*a* and 71*b* serving as a bearing for the rotation of the fastening plate 4 (compare FIG. 5). The fastening plate 4 is provided with a central circular opening 14, which is knurled correspondingly, in which the adjusting disk 7 is held in its pre-determined position. In this arrangement the correct position and angle position of the fastening plate 4 can be established relative to the snowboard 3 in the manner known generally, which is not described here in more detail. On the fastening plate 4 furthermore a frame part 15 containing two compression springs 18 and 19 arranged mutually parallel is mounted using nuts 16 screwed onto a threaded bolt 16' and a plurality of rubber elastic spacer washers 17. The compression springs 18 and 19 press against a pressure plate 20, supporting two rounded bolts 21 and 22 aligned in the axial direction of the two compression springs 18 and 19, seen at the right hand side in the figure, with the right hand side spring ends. At the left hand side ends of the two compression springs 18 and 19 a left hand side pressure plate 23 is provided containing a threaded bore into which a setting screw 26 is screwed. Opposite the pressure plate 23 a counter-plate 27 is provided presenting two rounded bolts 28 and 29 also aligned in the axial direction of the compression springs 18 and 19. The counter-plate 27 is pressed under a pre-determined force using the setting screw 26 and the compression springs 18 and 19 against the left hand side inner wall of the frame part 15. For this purpose a stepped bore—not visible in the figure—is provided against which the stepped screw head 30 of the setting screw 26 rests. By adjusting the setting screw 26 thus the pressure acting onto the four bolts 21, 22, 28 and 29 can be set to a predetermined value. The right hand side or front of the frame part 15 furthermore presents two fork-type parallel prongs 32 serving as guides for the boot plate 5 during insertion of the boot (see below). On the left hand side in FIG. 2 a so-called stopper 33 is provided on the fastening plate 4 consisting of an omega-shaped wire loop 34 with angled-off ends 35 and 36 penetrating through correspondingly angled-off recesses 37 of the fastening plate 4. The free end zones 38 of the wire loop 34 are laid out at an acute angle with respect to the oval part of the omega-shape, whereas the end zones 38 being arranged in a plane extending at right angles with respect to the omega-shaped part. Thus the wire loop 34 owing to these spring elastic end zones 38 presses the stopper 33 in to the triggering position illustrated in the figure. On the wire loop 34 a pressure plate 90 with a roll 91 and a (-shaped frame 92 is provided. The compression springs 18 and 19 are covered from above by a cover 40 which using clamping protrusions 41 engaging corresponding grooves (not shown) is clamped onto the frame part 15 in such a manner that the frame part 15, at least towards its upper side and laterally, is sealed off completely in such a manner that snow, ice and dirt can not each the compression springs. Furthermore the cover 40 is provided with a rib 42 extending in its longitudinal direction and protruding downward between the compression springs 18 and 19 and engaging corresponding grooves 43 in the right hand side pressure plate 20, in the left hand side pressure plate 23 and in the counter-plate 27.

The cover 40 also can be rotated over 180° and then can be put over the compression springs 18 and 19. As the rib 42 with respect to the longitudinal direction is laid out asymmetrically and on both sides is somewhat shorter than the length of the cover 40 and as only on the pressing plate 23 a corresponding groove 43' is provided the rib 42 serves as a stop for the right hand side pressure plate 20 and the counter-plate 27 in such a manner that these elements can not be moved inward further, i.e. that the bolts 21, 22, 28 and 29 are fixed in the troughs 48 of the boot plate 5 (see below). Thus a release triggering of the safety binding 1 is precluded, which may be desired in certain situations by experienced snowboarders.

Figure 3:
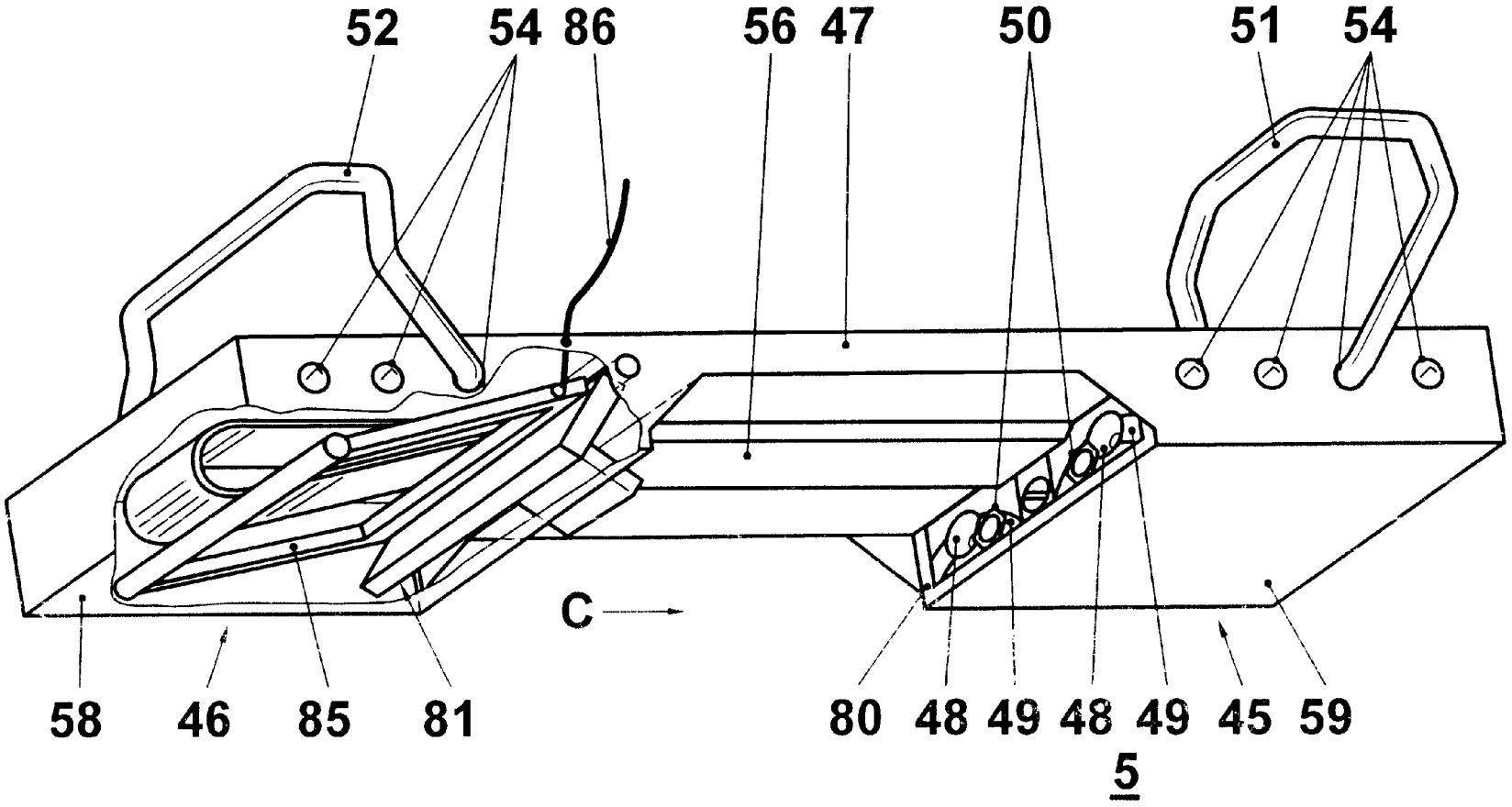

The second part 5 designated as boot plate is shown in an axonometric view in FIG. 3. It consists of two counter elements 45 and 46 which are held back by a bridging connection plate 47. The right hand side counter element 45 presents a fixedly arranged clamping jaw 80, and the left hand side counter element 46 presents a clamping jaw 81 which is rotatable with respect to its longitudinal direction The right hand side counter element furthermore presents outer contours laid out in such a manner that it fits into the frame part 15 between the fork-type prongs 32. The length of the connection plate 47 approximately corresponds to the length of the frame part 15, i.e. it slightly exceeds the length of the latter and is of the same width as the frame part 15. The connection plate 47 thus completely covers the frame part 15. The two clamping jaws 80 and 81 on their sides opposite the bolts 21 and 22, and 28 and 29 respectively, are provided with an arched groove 49 provided with troughs 48 (visible in the figure only on the clamping jaw 80). The bolts 21, and 27 respectively, during the insertion process engage (see below) the corresponding troughs 48. In order to be able to pre-set the triggering torque moment in vertical direction a screw 50 each is provided in the groove 49 adjacent to the troughs towards the inner side which are screwed into corresponding threaded bores not visible in the figure. Of the screws 50 just the ends protruding into the groove 49 are visible. Thus the force required for releasing the boot plate 5 from the fastening plate 4 in vertical direction can be adapted individually to the foot rotation moments exerted inwards and outwards by the snowboarder. In the same manner the bolts 28, and 29 respectively, engaged the corresponding troughs (not shown here) in the clamping jaw 81. On the counter-elements 4 and 46 a tensioning stirrup member 51 and 52 each are provided which hold down the ski boot or snowboard boot. Laterally in the counter elements 45 and 46 setting bores 54 are provided at equal distances between them in such a manner that the positions of the tensioning members 51 and 52 can be set according to the boot size. The lower side of the connection plate 47 is provided with a recess 56, mirroring the shape of the fastening plate 4, which facilitates insertion and guidance. Furthermore the counter elements 45 and 46 on their lower sides each are provided with a sole made from a suitably profiled hard synthetic material. The snowboarder thus can walk about with the boot plates 5 strapped to his ski boots or snowboard boots. It also should be noted that the dimensions of the boot plate 5 do not exceed the ones of the ski boot or snowboard boot soles.

Figure 5:
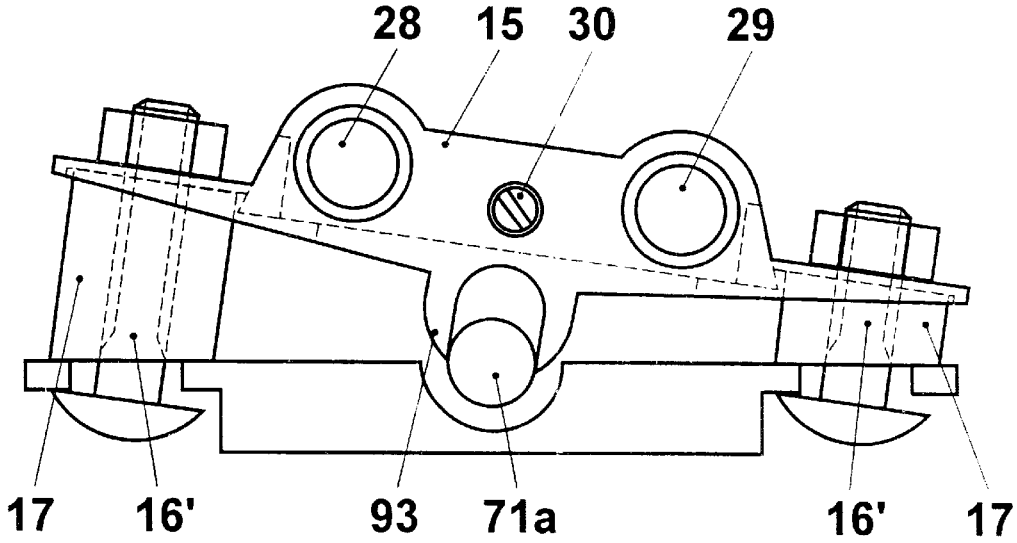
Figure 6:
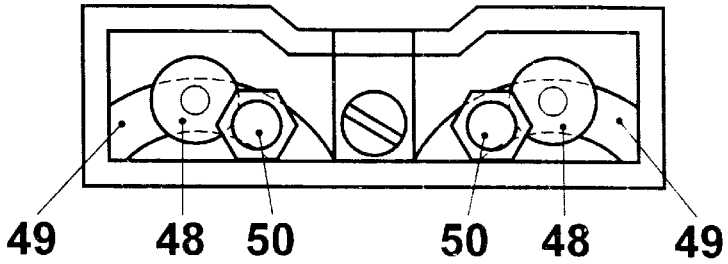
Figure 4:
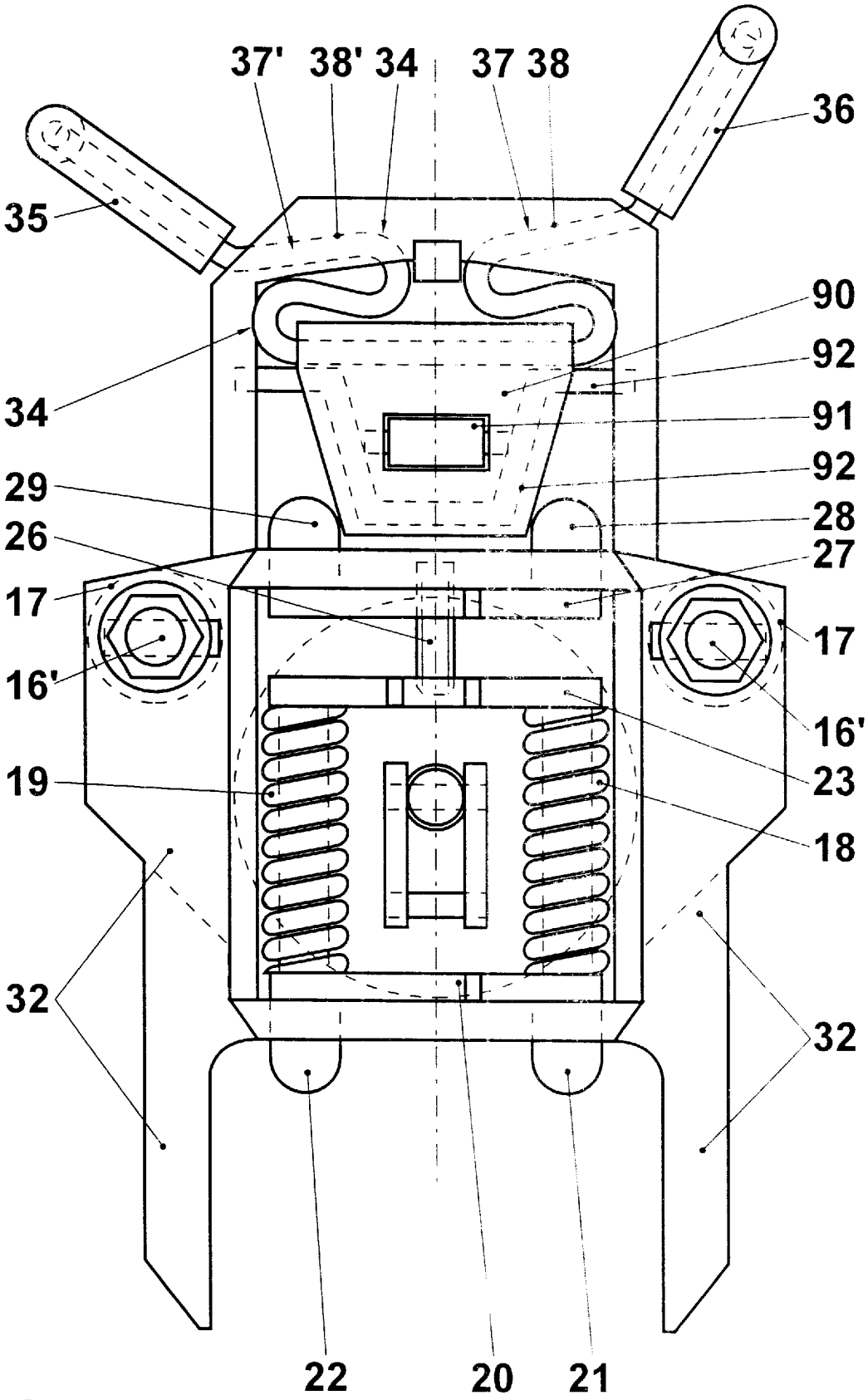

In FIG. 4 a fastening plate 4 is shown in a top view in the direction of the arrow A according to FIG. 2 (cover 40 not being represented). In this figure in particular the lay-out of the wire loop 34 with its angled-off end zones 38 can be seen. The prongs 32 are stepped and are fastened to the frame part 15 by means of screws (not shown here). Owing to the stepped shape of the prongs hard shell boots presenting a smaller width as well as larger soft snowboard boots, so-called soft boots, can be used. In Fig. 5 a schematic view of the frame part 15 is given seen in the direction of the arrow B according to FIG. 2. From this illustration it can be seen that the frame part 15 on its left hand side as shown in FIG. 2 presents a fork member 93 supported rotatably and adjustable in its height position on the protrusion 71*b*. In FIG. 6 a schematic side view of the clamping jaw 80 in the direction of the arrow C according to FIG. 3 is shown. The opposite wall of the frame part 15 is rotatably supported on the opposite right hand side protrusion 71*b* owing to an enclosed recess or bore (not shown) However, the opposite wall can not be adjusted in its height position ill such a manner that the frame part 15 can be arranged under an angle of 3° to 10°, preferentially of 5° (which concerns the safety binding 1 for the front foot only).

In FIG. 4 a fastening plate 4 is shown in a top view in the direction of the arrow A according to FIG. 2 (cover 40 not being represented). In this figure in particular the lay-out of the wire loop 34 with its angled-off end zones 38 can be seen. The prongs 32 are stepped and are fastened to the frame part 15 by means of screws (not shown here). Owing to the stepped shape of the prongs hard shell boots presenting a smaller width as well as larger soft snowboard boots, so-called soft boots, can be used. In FIG. 5 a schematic view of the frame part 15 is given seen in the direction of the arrow B according to FIG. 2. From this illustration it can be seen that the frame part 15 on its left hand side as shown in FIG. 9 presents a fork member supported rotatably and adjustable in its height position on the protrusion 71*b*. In FIG. 6 a schematic side view of the clamping jaw 80 in the direction of the arrow C according to FIG. 3 is shown. The opposite wall of the frame part 15 is rotatably supported on the opposite right hand side protrusion 71*b* owing to an enclosed recess or bore (not shown). However, the opposite wall can not be adjusted in its height position in such a manner that the frame part 15 can be arranged under an angle of 3° to 10° , preferentially of 5° (which concerns the safety binding 1 for the front foot only).

The rotatably arranged clamping jaw 81 using a sliding guide plate 85 (compare FIG. 3) can be brought into two distinct engaging positions: In a first engaging position the clamping jaw 81 is arranged just like the clamping jaw 80, i.e. the boot plate 5 can be engaged. Using a cable 86 the clamping jaw can be tilted down in such a manner that the boot plate 5 no longer is held to the fastening plate 4 by the bolts 28 and 29—the so-called free release.

Using the safety binding 1 described above the following settings can be effected:

- A pre-setting of the fastening plate 4 which using rubber elastic spacer washers 17 and the screws 16 can be slightly tilted in a plane about its longitudinal direction over an angle of about 3° to 10° , preferentially 5° (so-called "canting");
- A pre-setting of the fastening plate 4 which, also with the help of the spacer washers 17 and the screws 16, can be angled in a plane extending at right angles to its longitudinal axis over an angle of 3° to 10° , preferentially of 5° (the so-called "heel"). By suitably adjusting "canting" and "heel" settings the optimum plane can be chosen for the foot sole in such a manner that no pre-tensioning is exerted by the foot onto the fastening plate 4. This particularly concerns the hind foot whereas the front foot is placed substantially flat on the snowboard;
- A release triggering threshold for the rotation about the x-axis, i.e. by a torque moment $M_x$, effected by setting the pressure exerted by the compression springs 18 and 19 with the help of the setting screw 26;
- A release triggering threshold for the rotation about the y-axis, i.e. by a torque moment $M_y$, effected by setting the pressure exerted by the compression springs 18 and 19 with the help of the setting screw 26: and
- A release triggering threshold for the rotation about the z-axis. i.e. by a torque moment $M_z$, effected by setting one of the setting screws 50 in the groove 49 of the clamping jaws 45, and 46 respectively.

Thus the release triggering torque moments can be set for the individual snowboarder in such a manner that false releases can be practically excluded.

The snowboard boot 2 now is connected to the snowboard via the safety binding 1 in the following manner:

First the two boot plates 5 are clamped onto the underside of the snowboard boots 2 using the clamping stirrup members 51 and 52 whereupon the boot plate 5 is tilted forward and engagingly snapped into the two troughs 48 of the front clamping jaw 45 by means of the rounded bolts 21 and 22. The right hand side counter element 45 for this purpose is inserted between the fork-type prongs 32 of the frame part 15 which thus serves for facilitating the insertion. Subsequently the left or the back counter-element 46 using the heel is snapped in with the help of the rounded bolts 28 and 29. In this process these bolts 28 and 29 owing to the particular lay-out of the groove 49 are pressed inward before they snap into the troughs 48. This type of boot insertion is known generally as "step-in" for ski bindings. Other than with the safety bindings of the type "Meyer" described in the introduction the foot is not required to be rotated but here the boot plate 5 can engage the fastening plate 4 with the help of the heel. Insertion is further facilitated by the recess in the cover 40 of the fastening plate 4 and the correspondingly shaped recess 56 in the boot plate 5. During insertion the stopper 33 simultaneously is brought into its run position, i.e. the pressing plate 90 with its roll 91 is pressed downward by the heel in such a manner that the pressing plate 90 is "shifted" downward in parallel by the U-shaped lever member 92.

In FIG. 4 furthermore an alternative variant is shown of the wire loop element 34 bent in omega-shape in which the end zone 38' is angled off further with respect to the oval part of the wire loop 34, with the recess 37' in the fastening plate 4 being laid out accordingly. In this arrangement greater spring force is exerted acting onto the stopper 33 in such a manner that the stopper is triggered more easily.

Furthermore it is clear to one of skill in the art that the fastening plate 4 also could comprise the clamping jaws 45 and 46 as engaging elements and that the boot plate 5 could comprise the compression springs 18 and 19 in which arrangement two compression springs each are to be arranged in the left hand side and in the right hand side jaws 45, and 46 respectively. In a further design, the connection plate 47 would present a greater height dimension than the two counter elements 45 and 46, however such a design would be less suitable for practical reasons.

Of course the boot plate 5 also could be fastened to the snowboard boot 2 directly by means of screws or fixed during the extrusion process of the sole of the snowboard boot 2 instead of using clamping stirrup members.

In order to be able to determine the triggering torque moments in a simple manner the fastening plate 4 is taken off the adjusting disk 7 using the twist-tilt lever 9, and a threaded rod—not shown here in detail—with a ball mounted thereon is screwed into the screw nut 10. An adapter member similar to the frame part 15 with rigid bolts instead of the bolts 21, 22, 28 and 29 and a pan then is engaged with the boot plate 5. The snowboarder now places the snowboard boots 2 with said pan of the adapter member onto the ball in Such a manner that rotation is possible more or less in every direction. On the adapter member furthermore a longer lever arm is provided to which a spring scale can be mounted. The isometric maximum muscle power of the calf muscles thus can be measured for determining the triggering moment for the safety binding a procedure which can be effected at any sales or service point and can be used for setting the safety binding.

The triggering moments of the two safety bindings 1 thus can be set individually for each foot in such a manner that simultaneous release triggering is secured at all times without any mechanical connection between the two bindings.

List of Reference Signs Used in the FIGS.

| | |
|---|---|
| 1 | safety binding |
| 2 | snowboard boot |
| 3 | snowboard |

-continued

List of Reference Signs Used in the FIGS.

| | |
|---|---|
| 4 | fastening plate |
| 5 | boot plate |
| 7 | adjusting disk |
| 8 | through screw bolt |
| 9 | twist-tilt lever |
| 10 | nut |
| 11 | small lateral plate |
| 12 | U-shaped rail |
| 13 | L-shaped profile |
| 14 | opening |
| 15 | frame part |
| 16 | nut |
| 16' | threaded bolt |
| 17 | spacer washer |
| 18 | compression spring |
| 19 | compression spring |
| 20 | pressing plate |
| 21 | bolt |
| 22 | bolt |
| 23 | left hand side pressing plate |
| 26 | setting screw |
| 27 | counter-plate |
| 28 | bolt |
| 29 | bolt |
| 30 | screw head |
| 32 | prong |
| 33 | stopper |
| 34 | wire loop |
| 35 | angled off end |
| 36 | angled off end |
| 37 | recess |
| 38 | free end zone |
| 40 | cover |
| 41 | clamping protrusion |
| 42 | protruding rib |
| 43 | groove |
| 45 | counter-element |
| 46 | counter-element |
| 47 | connection plate |
| 48 | trough |
| 49 | groove |
| 50 | screw |
| 51 | clamping stirrup member |
| 52 | clamping stirrup member |
| 54 | adjusting bore |
| 56 | recess |
| 58 | sole |
| 59 | sole |
| 70 | outer rim |
| 71a | protrusion |
| 71b | protrusion |
| 80 | clamping jaw |
| 81 | rotatable clamping jaw |
| 85 | guide slot plate |
| 86 | cable |
| 90 | pressing plate |
| 91 | roll |
| 92 | U-shaped frame |
| 93 | fork |
| $M_x$ | torque moment in the x-direction |
| $M_y$ | torque moment in the y-direction |
| $M_z$ | torque moment in the z-direction |

I claim:

1. A safety binding device for a snowboard comprising:

(a) a first part to be secured to a snowboard;

(b) a second part to be connected to a boot; and (c) a locking mechanism for connecting the first and second parts, wherein the locking mechanism comprises:

(i) two compression springs arranged substantially parallel to each other and substantially parallel to a horizontal axis of the device;

(ii) a first and a second bolt located at a first end of the compression springs and a pressure plate located at a second end of the compression springs, the pressure plate contacting a third and a fourth bolt aligned with the compression springs, wherein each bolt meshes with an engaging element provided on the second part, each engaging element being provided with an insert means for setting a trigger threshold for release of the locking mechanism by rotation about a longitudinal direction of a shin-bone of a wearer when the device is in use; and (iii) an adjustable counter plate positioned between the compression springs and the pressure plate in order to set a trigger threshold for release of the locking mechanism by rotation in a longitudinal direction and by rotation about a foot joint of a wearer when the device is in use, whereby a force exerted by the counter plate is transferred to the bolts by means of the compression springs.

2. A safety binding device according to claim 1, wherein said counter plate is adjustable to set the spring tension force of the compression springs onto said bolts.

3. A safety binding device according to claim 1, wherein said insert means on said engaging elements are adjustable.

4. A safety binding device according to claim 1, wherein said compression springs are adjustable via the counter plate by means of a rotatable spacing element.

5. A safety binding device according to claim 1, wherein said engaging elements have the shape of a trough.

6. A safety binding device according to claim 1, wherein said engaging elements are formed as an arched groove with a recessed trough for each of said bolts.

7. A safety binding device according to claim 6, further comprising height adjustable inserts provided in said grooves in order to adjust said release triggering threshold.

8. A safety binding device according claim 1, wherein said first part is formed as a fastening plate and said second part is formed as a boot plate.

9. A safety binding device according to claim 8, wherein said fastening plate is adjustable over an angle of about 3° to 10° with respect to its longitudinal direction and over an angle of about 3° to 10° with respect to an axis extending at right angles to its longitudinal direction.

10. A safety binding device according to claim 9, wherein each of said angles is adjustable by means of a setting screw and by means of rubber-elastic spacer washers.

11. A safety binding device according to claim 8, wherein said fastening plate is adjustable over an angle of about 5° with respect to its longitudinal direction and over an angle of about 5° with respect to an axis extending at right angles to its longitudinal direction.

12. A safety binding device according to claim 8, wherein a stopper is provided on said fastening plate, and said stopper is triggered automatically into a stopping position after release of the locking mechanism.

13. A safety binding device according to claim 1, further comprising an additional pressure plate located between said first and second bolts and said compression springs.

* * * * *

UNITED STATES PATENT AND TRADEMARK OFFICE

CERTIFICATE OF CORRECTION

PATENT NO. : 6,428,032 B1
DATED : August 6, 2002
INVENTOR(S) : Roger Marcel Humbel It is certified that error appears in the above-identified patent and that said Letters Patent is hereby corrected as shown below:

Column 5,
Line 8, replace "21, and 27 respectively" with -- "21, and 22 respectively --
Line 21, replace "counter-elements 4 and 46" with -- counter-elements 45 and 46 --
Lines 60-68, delete in its entirety.

Column 6,
Lines 1-15, delete in its entirety.

Signed and Sealed this

Twenty-second Day of April, 2003

JAMES E. ROGAN
*Director of the United States Patent and Trademark Office*